US012565741B1

(12) United States Patent
Hudson

(10) Patent No.: US 12,565,741 B1
(45) Date of Patent: Mar. 3, 2026

(54) CONCRETE SURFACE FINISHING APPARATUS

(71) Applicant: Jason Andrew William Hudson, Riverton (CA)

(72) Inventor: Jason Andrew William Hudson, Riverton (CA)

( * ) Notice: Subject to any disclaimer, the term of this patent is extended or adjusted under 35 U.S.C. 154(b) by 0 days.

(21) Appl. No.: 19/339,235

(22) Filed: Sep. 24, 2025

(51) Int. Cl.
*E01C 19/42* (2006.01)

(52) U.S. Cl.
CPC ..... *E01C 19/42* (2013.01)

(58) Field of Classification Search
CPC ..... E01C 19/42
USPC ..... 404/112
See application file for complete search history.

(56) References Cited

U.S. PATENT DOCUMENTS 2,860,506 A * 11/1958 Drummond ..... E04F 21/08 404/112
5,221,156 A * 6/1993 Martin ..... E04F 21/248 404/112
7,399,140 B2 * 7/2008 Barcenas ..... E04F 21/248 404/112
8,757,925 B2 * 6/2014 Banchio ..... B24B 23/02 404/112
2004/0022581 A1 * 2/2004 Corbitt ..... E04F 21/245 404/112
2006/0083589 A1 * 4/2006 McClain ..... B24B 7/18 404/112
2023/0123674 A1 * 4/2023 Kipp, Jr. ..... E04F 21/247 404/112

* cited by examiner

*Primary Examiner* — Raymond W Addie
(74) *Attorney, Agent, or Firm* — Orin Del Vecchio

(57) ABSTRACT

A concrete surface finishing apparatus having a rotational support assembly wherein the rotational support assembly includes two rotational support member drives having support members that are configured to have floats and trowels releasably secured thereto so as to assist a user in finishing the surface of poured concrete. The apparatus includes support members operably coupled to a rotational hub that provides rotational movement thereof. The support members include a keeper formed thereon wherein the keeper is configured to operably couple to a mounting member that facilitates the releasable securing of float members and trowel members. The support members have a first end and a second end wherein the second end has a width that is greater than the first end. The rotational support assembly further includes an outer ring member providing protection for the float members and trowel members during rotational movement.

7 Claims, 2 Drawing Sheets

CONCRETE SURFACE FINISHING APPARATUS

FIELD OF THE INVENTION

The present invention relates generally to concrete installation, more specifically but not by way of limitation, a handheld machine that is configured with two rotatable support assemblies wherein the rotatable support assemblies are configured to have floats and trowels releasably secured thereto so as to assist a user in finishing poured concrete.

BACKGROUND

When concrete is poured, the material undergoes a crucial transformation from a workable slurry into a hardened surface. In this transitional state, finishing operations such as floating and troweling are necessary to create a level, durable, and aesthetically acceptable surface. Floating is typically the first step after the concrete has been struck off and screeded. Floating involves the use of flat tools that push down coarse aggregate, bringing a cream of cement paste to the surface. This step fills minor voids and evens out surface irregularities. Troweling follows, refining the surface further by compacting and smoothing the paste, ultimately producing a dense and polished finish. Together, these steps are essential to ensuring both the structural performance and appearance of concrete.

While these processes are fundamental, performing them by hand presents significant challenges. Floating requires wide, sweeping motions with large magnesium or wood tools, demanding repetitive effort and considerable physical strength. Similarly, hand troweling often performed with steel trowels requires precise wrist and arm control over extended periods, especially in large placements. These motions are not only labor-intensive but can lead to fatigue, strain injuries, and inconsistent results due to human variability. Moreover, timing is critical as concrete stiffens quickly, meaning laborers must balance speed and precision in a limited working window. On larger pours, this pressure can result in rushed work or incomplete finishing.

To address these challenges, the industry often employs large power trowels and ride-on finishing machines. These tools significantly reduce the burden of manual labor and can cover wide areas efficiently. However, they come with notable limitations. Their size and maneuverability make them unsuitable for working in confined spaces or near obstructions. Along edges, around columns, and adjacent to forms or existing walls, large machines simply cannot reach. Operators are therefore still forced to revert to traditional hand tools in these critical areas. Additionally, the weight and bulk of these machines make them impractical for smaller projects where precision and delicacy are more important than speed.

Given these constraints, there is a clear opportunity to innovate at the intersection of manual craftsmanship and mechanized efficiency. An automated handheld machine designed with interchangeable floats and trowel blades could bridge this gap. Such a device would allow workers to access tight spaces while benefiting from motorized assistance that reduces fatigue and ensures consistent surface quality. Unlike large machines, this handheld solution would be portable, lightweight, and versatile, making it equally useful on both large-scale construction sites and smaller projects. By automating the repetitive aspects of finishing without sacrificing precision in restricted areas, such a tool could dramatically reduce manual labor while enhancing safety, consistency, and productivity.

Floating and troweling are indispensable stages in concrete finishing, yet they remain physically demanding and time-sensitive when performed manually. While large automated machines have advanced efficiency, they cannot replace the need for precise, close-quarters finishing along edges and forms. Developing a compact, automated handheld machine equipped with both floats and trowel blades presents a practical solution that complements existing technology. This innovation would reduce worker strain, increase efficiency, and ensure high-quality finishes in areas that currently rely solely on hand tools.

Accordingly, there is a need for a handheld machine that is configured with two rotatable support assemblies wherein the rotatable support assemblies are configured to have floats and trowels releasably secured thereto so as to assist a user in finishing poured concrete.

SUMMARY OF THE INVENTION

It is the object of the present invention to provide a handheld automated concrete finishing machine configured to finish a surface of poured concrete wherein the present invention includes an upper assembly having an electric motor and a user interface.

Another object of the present invention is to provide a handheld machine that provides automated floating and troweling of a concrete surface wherein the present invention includes a rotational support assembly.

A further object of the present invention is to provide a handheld automated concrete finishing machine configured to finish a surface of poured concrete wherein the rotational support assembly includes support blade members and an outer ring member.

Yet a further object of the present invention is to provide a handheld machine that provides automated floating and troweling of a concrete surface wherein the rotational support members include keepers formed therein.

Still another object of the present invention is to provide a handheld automated concrete finishing machine configured to finish a surface of poured concrete wherein the present invention includes a plurality of float members.

An additional object of the present invention is to provide a handheld machine that provides automated floating and troweling of a concrete surface wherein the present invention includes a plurality of trowel members.

Yet a further object of the present invention is to provide a handheld automated concrete finishing machine configured to finish a surface of poured concrete wherein the float members and trowel members are configured to releasably secure to the keepers on the rotational support members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
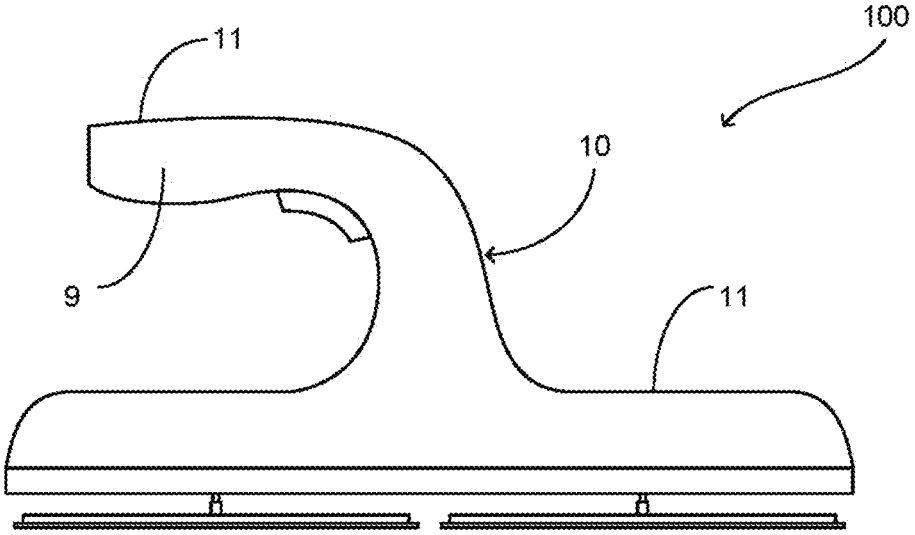
FIG. 1 is a side view of an embodiment of the present invention.
Figure 2:
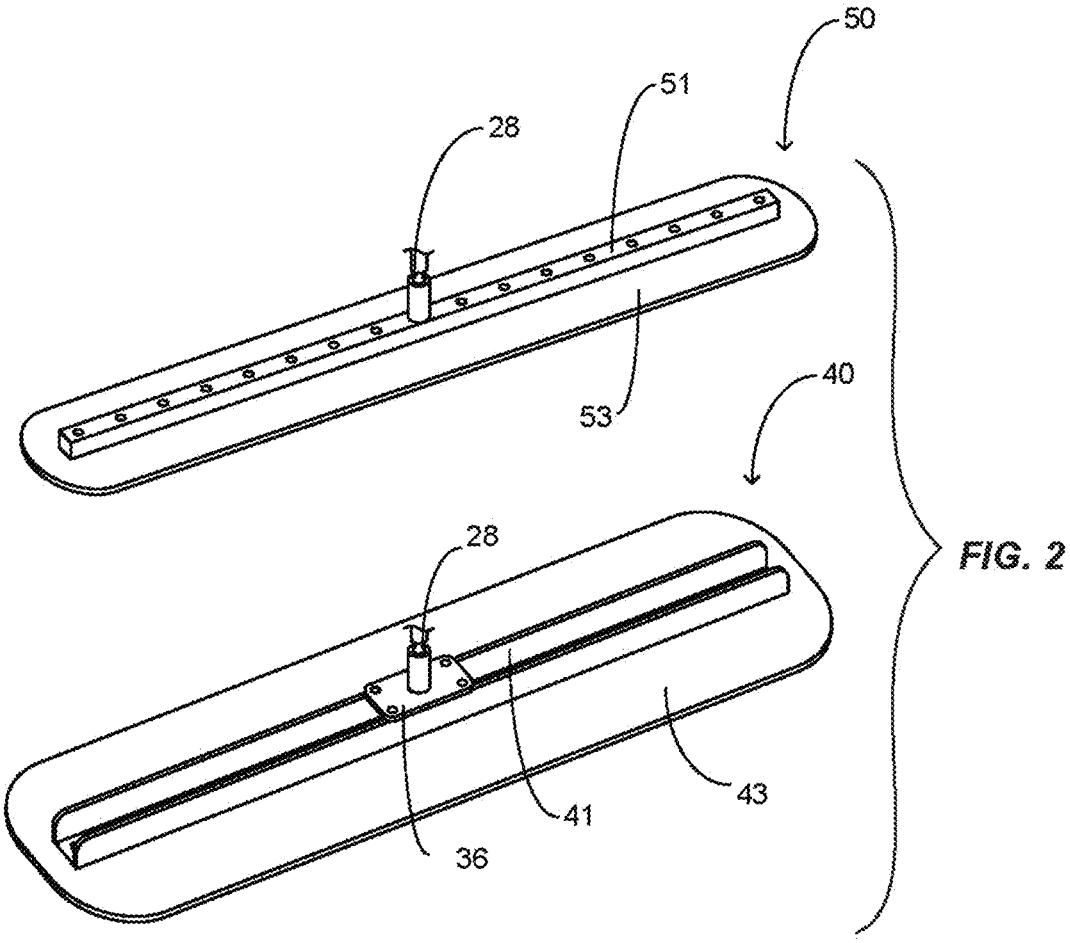
FIG. 2 is a top perspective view of a float member and a trowel member of the present invention.
Figure 3:
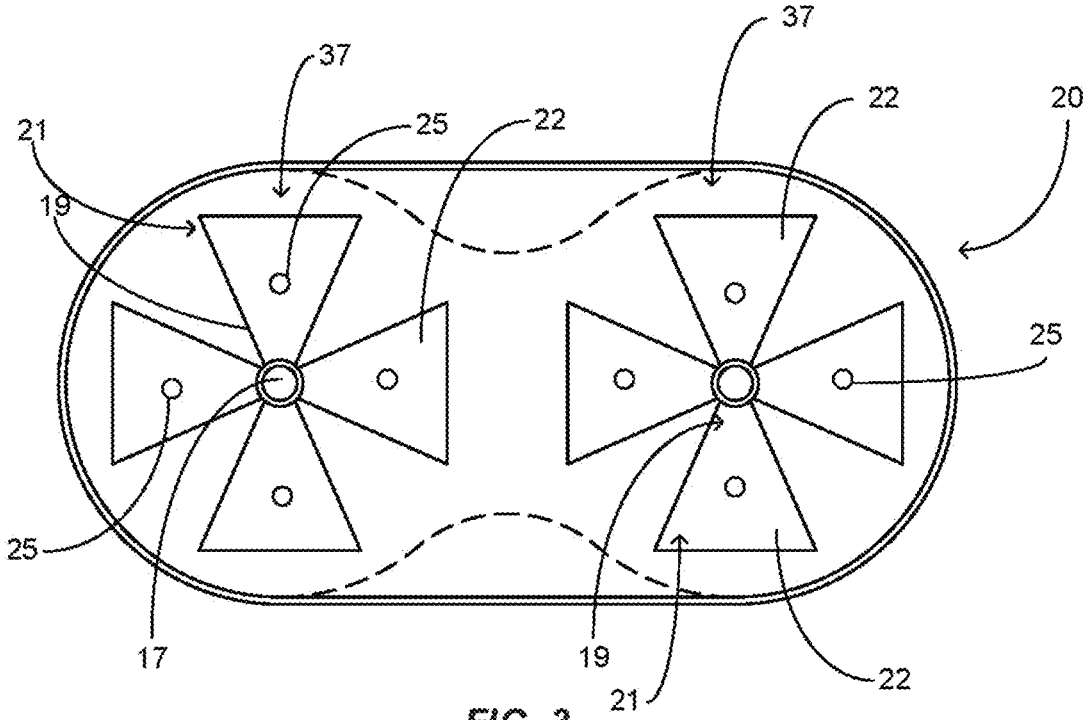
FIG. 3 is a bottom view of the rotational support assembly of the present invention.

Referring now to the drawings submitted herewith, wherein various elements depicted therein are not necessarily drawn to scale and wherein through the views and figures like elements are referenced with identical reference numerals, there is illustrated a concrete surface finishing apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, concrete surface finishing apparatus 100 includes an upper assembly 10 wherein the upper assembly 10 includes outer walls 11 formed from a durable material such as but not limited to plastic. The upper assembly 10 includes a handle member 9 formed as a part thereof and while not particularly illustrated herein has an electric motor disposed therein. It should be understood within the scope of the present invention that the concrete surface finishing apparatus 100 is powered utilizing either battery power or conventional alternating current power or a combination thereof. It should be further understood within the scope of the present invention that the electric motor disposed within the upper assembly 10 could be provided in alternate sizes. While a particular shape for the upper assembly 10 is illustrated herein, it is contemplated within the scope of the present that the upper assembly 10 could be provided in numerous alternate shapes.

Operably coupled to the upper assembly 10 proximate the bottom thereof is the rotational support assembly 20. The rotational support assembly 20 is operably coupled to the upper assembly 10 utilizing suitable mechanical techniques. The rotational support assembly 20 is comprised of two rotational support member drives 37 that each include a plurality of support members 22 wherein the support members 22 are rotatably movable. The support members 22 are configured to have operably coupled thereto the float members 40 and trowel members 50 as is further discussed herein. The support members 22 have formed thereon a keeper 25 wherein the keepers 25 is configured to releasably secured to mounting member 28 of the float members 40 and trowel members 50. The support members 22 include a first end 19 and a second end 21 wherein the first end 19 is proximate the rotational hub 17 wherein rotational hub 17 is operably coupled to the electric motor disposed within the upper assembly 10. The support members 22 have a width at the second end 21 that is greater than the width at the first end 19. The support members 22 are formed in the aforementioned shape to achieve a desired objective. When a downward force acts on the support members 22, the force is distributed thereacross. As the support members 22 have a greater width at the second end 21 this presents a larger surface area proximate the second end 21. As pressure is defined as force per unit area, and the load distributes proportionally to area, the wider end of the second end 21 experiences a greater share of the downward pressure placed on the present invention by a user during the act of floating or troweling. The support members 22 spins about hub 17 and the downward force acting on the support member 22 farther from the hub 17 has a greater lever arm. This means the downward force at the second end 21 is magnified because it acts at a greater radius and as such the present invention has the necessary force proximate the outer ring 34 to execute concrete surface finishing without defects proximate the area of the outer ring 34. While the support members 22 are illustrated and discussed herein as being a particular shape, it is contemplated within the scope of the present invention that the support members 22 could be uniform in width. The aforementioned provides an improved force distribution to the float member 40 and trowel member 50 providing a desired result for the concrete surface. While four support members 22 per hub 17 are illustrated herein, it is contemplated within the scope of the present invention that more or less than four support members 22 could be utilized. The outer ring 34 is present so as to inhibit damage to the support members 22, float members 40 and trowel members 50 during operation of the concrete surface finishing apparatus 100.

The concrete surface finishing apparatus 100 includes a plurality of trowel members 50 and float members 40 that are releasably secured to the support members 22 wherein the mounting member 28 is operably inserted into keeper 25. It is contemplated within the scope of the present invention that the mounting member 28 and keeper 25 could be constructed from various mechanical fasteners that would facilitate the desired objective of releasably securing the trowel members 50 and float members 40 to the support members 22. The trowel member 50 includes longitudinal support member 51 that is operably coupled to the mounting member 28 extending outward therefrom on opposing sides thereof. Longitudinal support member 51 is manufactured from a suitable rigid material such as but not limited to metal. Secured to the longitudinal support member 51 is trowel blade 53. Trowel blade 53 is planar in manner being manufactured from metal or other suitable material and it should be understood within the scope of the present invention that the trowel blade 53 is approximately one-eighth of an inch in thickness.

The float member 40 includes longitudinal support member 41 that is operably coupled to the mounting member 28 extending outward therefrom on opposing sides thereof. Mounting member 28 is secured to plate member 36 for added stability due to the material of the float blade 43. Longitudinal support member 41 is manufactured from a suitable rigid material such as but not limited to metal. Secured to the longitudinal support member 51 is float blade 43. Float blade 43 is planar in manner being manufactured from rubber foam or other suitable material and it should be understood within the scope of the present invention that the float blade 43 is approximately one-quarter to one-half inch in thickness.

In a first mode of the concrete surface finishing apparatus 100 the float members 40 are releasably secured to the support members 22 in order to execute the first step of concrete finishing. In the second mode of the concrete surface finishing apparatus 100, the trowel members 50 are releasably secured to the support members 22 in order to execute the final step of concrete surface finishing.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable handheld concrete surface finishing apparatus wherein the concrete surface finishing apparatus comprises:

an upper assembly, said upper assembly having a wall forming an interior volume, said upper assembly having a handle member integrally formed as a part thereof;

a rotational support assembly, said rotational support assembly having two rotational support member drives, said two rotational support member drives configured to rotatably move around a hub, said two rotational support member drives having at least two support members, said at least two support members having a first end and a second end, said first end of said at least two support members being proximate said hub of each of said two rotational support member drives, said at least two support members having a keeper integrally formed thereon;

a trowel member, said trowel member being releasably secured to said at least two support members of said two rotational support member drives, said trowel member being releasably secured to said at least two support members of said two rotational support member drives in a second mode of the concrete surface finishing apparatus; and a float member, said float member being releasably secured to said at least two support members of said two rotational support member drives, said float member being releasably secured to said at least two support members of said two rotational support member drives in a first mode of the concrete surface finishing apparatus.

2. The portable handheld concrete surface finishing apparatus as recited in claim 1, wherein said trowel member includes a longitudinal support member, said longitudinal support member being located proximate a midpoint line of the trowel member and further extending substantially a full length thereof.

3. The portable handheld concrete surface finishing apparatus as recited in claim 2, wherein said at least two support members have a width proximate said second end that is greater than a width proximate said first end.

4. The portable handheld concrete surface finishing apparatus as recited in claim 3, wherein said float member includes a longitudinal support member, said longitudinal support member of said float member being located proximate a midpoint line of the float member and further extending substantially a full length thereof.

5. The portable handheld concrete surface finishing apparatus as recited in claim 4, wherein said rotational support assembly further includes an outer ring member, said outer ring member being circumferentially disposed around the two rotational support member drives.

6. The portable handheld concrete surface finishing apparatus as recited in claim 5, wherein said longitudinal support member of said float member further has a mounting member centrally mounted thereto, said mounting member configured to operably couple to said keeper of said at least two support members.

7. The portable handheld concrete surface finishing apparatus as recited in claim 6, wherein said longitudinal support member of said trowel member further has a mounting member centrally mounted thereto, said mounting member of said longitudinal support member of said trowel member configured to operably couple to said keeper of said at least two support members.

* * * * *